US006910233B2

(12) United States Patent
Helge

(10) Patent No.: US 6,910,233 B2
(45) Date of Patent: Jun. 28, 2005

(54) ELONGATED ROLLER SHUTTER PROFILE MADE OF PLASTIC OR METAL FOR SWIMMING POOL COVERS

(75) Inventor: Hans Heinz Helge, 19 Manaihant, D-4800 Petit-Rechain (BE)

(73) Assignee: Hans Heinz Helge, Petit-Rechain (BE)

( * ) Notice: Subject to any disclaimer, the term of this patent is extended or adjusted under 35 U.S.C. 154(b) by 0 days.

(21) Appl. No.: 10/641,607

(22) Filed: Aug. 15, 2003

(65) Prior Publication Data

US 2004/0031217 A1 Feb. 19, 2004

(30) Foreign Application Priority Data

Aug. 15, 2002 (DE) ..... 102 38 165

(51) Int. Cl.[7] ..... E04H 4/00
(52) U.S. Cl. ..... 4/502; 4/498; 4/500
(58) Field of Search ..... 4/498, 500–502; 220/235, 364, 365, 521, 801

(56) References Cited

U.S. PATENT DOCUMENTS 1,349,610 A * 8/1920 Gibney ..... 137/371
3,618,811 A * 11/1971 Martino ..... 220/235
3,812,810 A * 5/1974 Moeller ..... 220/235
5,115,554 A * 5/1992 Fell, Sr. ..... 4/252.4
5,419,650 A * 5/1995 Hoshino ..... 403/370
5,732,846 A 3/1998 Helge

FOREIGN PATENT DOCUMENTS

EP 0225862 6/1987
EP 0732469 9/1996

* cited by examiner

*Primary Examiner*—Tuan Nguyen
(74) *Attorney, Agent, or Firm*—W. F. Fasse; W. F. Fasse

(57) ABSTRACT

An elongated roller shutter profile of plastic or metal for swimming pool covers has a water-proof closure that closes an end of at learnt one longitudinal hollow chamber of the roller shutter profile. The closure includes a cap at least partly inserted from the end into the chamber, a piston plate spaced from the cap, and a sealing body between the cap and the piston plate. The sealing body made of an elastic and/or plastic material is brought into a sealing state by clamping between the piston plate and the cap so that the sealing body expands in width and rests in a circumferentially tight manner on the inner walls of the hollow chamber.

16 Claims, 5 Drawing Sheets

25a
14a
13a
24a
12a
3a
8
9
10
4
2
15
17a
6
3b
23
17b
5
11
7
16
25b
14b
13b
24b
12b
1

19a
17a
17b
19b
15

21
18
20b
22
14b
16
11
15
17b
13b
12b
3b
23
1

20b
20a
11
19b
15
19a
14b
16
14a

ELONGATED ROLLER SHUTTER PROFILE MADE OF PLASTIC OR METAL FOR SWIMMING POOL COVERS

FIELD OF THE INVENTION

The invention relates to an elongated roller shutter profile made of plastic or metal for swimming pool covers, comprising at least one water-proof closure with which at least one hollow chamber extending in the longitudinal direction of the roller shutter profile can be closed off on a face side of the roller shutter profile, with the closure comprising a cap which is at least partly insertable into the hollow chamber from the face side, comprises a piston plate disposed at a distance to the cap within the respective hollow chamber and a sealing medium extending between the cap and the piston plate.

BACKGROUND INFORMATION

Such a roller shutter profile is known for example from EP 0 225 862 A1 as well as EP 0 732 469 A1. The known roller shutter profiles are used in particular in the form of extruded plastic profiles for swimming pool covers. Since the swimming pool covers lay on the water surface and should swim on the water surface due to the air-filled hollow chambers, it is important that the roller shutter profiles are occluded at their ends. Since such roller shutter profiles are used in the outside, special attention must be given to the fact that both the material of the roller shutter profile per se as well as the material of the closure are weatherproof, i.e. it must be especially resistant to UV radiation and larger temperature fluctuations. It is not permitted that the materials become brittle during the service life of such covers or will warp as a result of temperature fluctuations, which would lead to leakages.

In the roller shutter profiles as are known from EP 0 225 862 A1 as well as EP 0 732 469 A1 the piston plates are each connected via a piston-rod-like shaft with the cap. The cap comprises a stopper section which is adjusted to the cross section of the respective hollow chamber and is introduced into the same. The cross section of the piston plate is similarly adjusted to the cross section of the hollow chamber. The impermeability is produced in such a way that the intermediate space between the piston plate and the stopper section is filled at first with sealing medium which is free-flowing at first, which sealing medium is introduced through an opening in the stopper section of the cap from the outside by means of a suitable filling means. The sealing medium which is based on a plastic material shows favorable adhesive properties which produce a permanent connection of the same with the walls of the hollow chamber and cures after a certain period of time. In this way a permanent closure of the roller shutter profile can be achieved which cannot be reversed. Whereas each hollow chamber is associated with its own supply opening and a venting or overflow opening adjacent thereto in the roller shutter profiles as known from EP 0 225 862 A1, the further development as known from EP 0 732 469 A1 is that adjacent hollow chambers can be closed off by way of a single filling process. For this purpose the liquid scaling medium flows at first through a supply opening into the first hollow chamber in order to then pass through an overflow duct into the adjacent hollow chamber and to move from there to further adjacent hollow chambers, if any. In the last hollow chambers which are thus connected in series there is a venting or overflow opening in the associated stopper section of the cap, so that the filling process can be ended at the time when the sealing medium emerges from said opening.

Even though it was possible to achieve a reduction of the working time in the production of waterproof closures in the further development as described in EP 0 732 469 B1, the use of such free-flowing and curing sealing mediums is generally problematic. One disadvantage is that the closures cannot be mechanically loaded directly after the filling with the sealing medium because it reaches the required hardness only after a certain period of time, i.e. it is capable of withstanding the action of a force. Moreover, the filling of the sealing medium into the intermediate space between the piston plate and the sealing cap can only occur with a certain conveyance rate, so that in practice there is a required time per hollow chamber to be filled of several seconds. A further disadvantage is that interruptions in the filling process lead to a curing of the sealing medium also in the filling apparatus, so that time-consuming cleaning work is necessary prior to resuming the filling.

SUMMARY OF THE INVENTION

The invention is based on the object of further developing a closure for a roller shutter profile for swimming pool covers in such a way that on the one hand the time required in producing the impermeable closure is reduced and on the other hand the removability of the sealing is enabled.

Based on the roller shutter profile of the kind mentioned above this object is achieved in accordance with the invention in such a way that the sealing medium is a sealing body made of an elastic and/or plastic material which based on a mounting state in which it can be introduced into the hollow chamber it can be brought into a sealing state by clamping between the piston plate and the cap in which it is expanded in a direction perpendicular to the longitudinal direction of the hollow chamber, so that it rests in a circumferentially tight manner on the walls delimiting the hollow space.

The closure in accordance with the invention thus differs at first from the state of the art in that a free-flowing sealing medium is no longer used, but a sealing body which although it has elastic and/or plastic properties is substantially dimensionally stable without any external action of a force. The sealing effect relative to the walls of the hollow chamber is achieved in accordance with the invention in such a way that a pressure is exerted on the sealing body on both sides in the direction of the longitudinal direction of the hollow chamber, so that a deformation of the same consequently occurs which produces an increase in the dimensions of the sealing body in the direction perpendicular to the longitudinal direction of the hollow chamber. This extension of the roller shutter profile produces a circumferential contact of the same on the walls of the hollow chamber, thus producing the desired sealing effect.

The use of a sealing medium is advantageously no longer required which changes its properties after the filling into the intermediate space between the piston plate and the sealing cap in such a way that it changes from a free-flowing state to a sufficiently solid one. A chemical or other change of material after fitting the roller shutter profile with the closure is no longer required according to the teachings in accordance with the invention. Ageing problems as may occur during an extended storage of the liquid sealing medium according to the state of the art need not be anticipated any longer in accordance with the invention. When using suitable materials the invention also allows a reversibility of the closure in the sense that after removing the clamping of the sealing body between the piston plate and the sealing cap there is a detachment from the walls of the roller shutter profiles due to a reverse formation of the sealing body, so that the closure can be removed again in its entirety. When using a sealing body which deforms in a exclusively plastic way and which may come with adhesion properties in conjunction with the walls of the hollow chamber, the property of reversibility is obviously not given because a reverse formation and detachment of the sealing body from the walls could hardly be achieved in this case.

It is principally imaginable that the piston plate rests with a projection on the walls of the hollow chamber which prevents a further displacement of the same into the interior of the hollow chamber and that a clamping between the piston plate and the cap is achieved in such a way that the cap also latches behind a projection for example. The distance between the piston plate and cap in this sealing state of the closure is dimensioned in such a way that the shortening of the sealing body in the axial direction which is thus obtained produces a sufficient radial expansion of the same in order to achieve producing contact with the walls with a sufficient amount of pre-tensioning.

It is provided for according to an especially preferred embodiment of the invention that a connecting element is provided which extends between the cap and the piston plate and is under tensile stress at least during the transfer of the sealing body into the sealing state. In this case it is not necessary to provide a support both for the piston plate as well as the cap on the walls of the roller shutter profile, which is especially advantageous in the case of extruded profiles because such projections (e.g. abutments) are not easy to make. Under certain circumstances it is sufficient to produce the tensile stress only once or for a certain period of time, namely when the sealing body consists of a plastic material which develops a strong adhesive force in conjunction with the walls of the hollow chamber. In this case it is not necessary to expect a reverse formation of the sealing body even after removing the tensile stress on the connecting element, i.e. a pressure relief of the sealing body, as a result of the elasticity properties which are manifested either in a weak way or not at all, so that the circumferential adherence to the walls will be maintained even without any further action of force on the sealing body.

In the case of roller shutter profiles with several hollow chambers which extend parallel with respect to each other and are separated from each other by a separating wall extending in the longitudinal direction of the roller shutter profile, the sealing process can be completed in an especially rational fashion when the closure comprises a cap which can be introduced into several hollow chambers simultaneously and which is associated with a number of sealing bodies and piston plates which corresponds to the number of hollow chambers.

In accordance with a further embodiment of the roller shutter profile in accordance with the invention, the connecting element penetrates the sealing body and the cap and is movable in the longitudinal direction of the hollow chamber relative to the sealing body and the cap. The penetration of the sealing body allows a reliable sealing on its circumference, i.e. a direct contact of the elastic or plastic material of the sealing body on the ambient chamber walls.

A further development of the invention is also that the connecting element is a screw whose thread cooperates with the piston plate. Preferably, the screw also penetrates the cap and rests with its screw head thereon on the outside. A metallic nut can be formed into the piston plate when it is produced by way of injection-molding, which metallic nut cooperates with the machine tap of the screw. As an alternative it is also possible to shape merely a pocket bore into the piston plate into which a screw with a self-cutting thread is turned.

An alternative embodiment of the roller shutter profile in accordance with the invention is that the rod-like connecting element is connected in an integral manner with the piston plate and comprises barbs on its surface which cooperate with a detent pawl which is arranged in the cap. In this type of connection between piston plate and cap which works according to the principle of cable binders, the process of producing the pre-tensioning on the sealing body is strongly simplified. A free end of the connecting element which projects from the cap merely needs to be pulled in the direction out of the hollow chamber with a defined force. The pre-tensioning on the sealing body is maintained permanently by the locking function of the barbs after removing the external tensile force. A reversible removal of the sealing effect is not possible in this kind of locking. An unlatching possibility for the detent pawl is possible in principle, however.

There is a further development of the roller shutter profile in the respect that the piston plate and/or the cap are elevated in a conical manner on the face-side contact surface facing the sealing body and the sealing body per se is sunk in a complementary conical manner on at least one of its two opposite face-side contact surfaces which correspond to the contact surfaces of the piston plate and/or the cap. The cooperation of the conical surface with the conical surface which is configured in a complementary fashion leads to an improved translation of the axial tension into a radially directed expansion of the sealing body in the case of the axial clamping of cap and sealing body or of piston plate and sealing body. The contact surfaces which are cone-shaped/conical in a complementary fashion can be attached either only to one side to the sealing body and the respectively adjacent component or also to both sides of the sealing body.

It is moreover possible to provide the sealing body with a gas filling in a hollow chamber which is inherently closed off in an annular way and is externally sealed off. In the case of an axial pressing of the sealing body between the piston plate and the cap, the compression of the hollow chamber leads to a radial expansion of the same due to its impermeability. In conjunction with the reduced wall thicknesses of the sealing body in the region between the hollow chamber and the wall of the hollow chamber of the roller shutter profile, the outside jacket of the sealing body sits close to the inside jacket of the hollow chamber in an improved manner.

It finally also lies within the scope of the present invention to provide a closure for sealing in a water-proof manner an elongated roller shutter profile made of plastic or metal, with the closure having the features and properties as described above. Such closures can be used for example as spare parts for roller shutter profiles which are already present or as independently marketable merchandise.

BRIEF DESCRIPTION OF THE DRAWINGS

The closure of a roller shutter profile in accordance with the invention is explained below by reference to several embodiments shown in the drawings, wherein.

Figure 1:
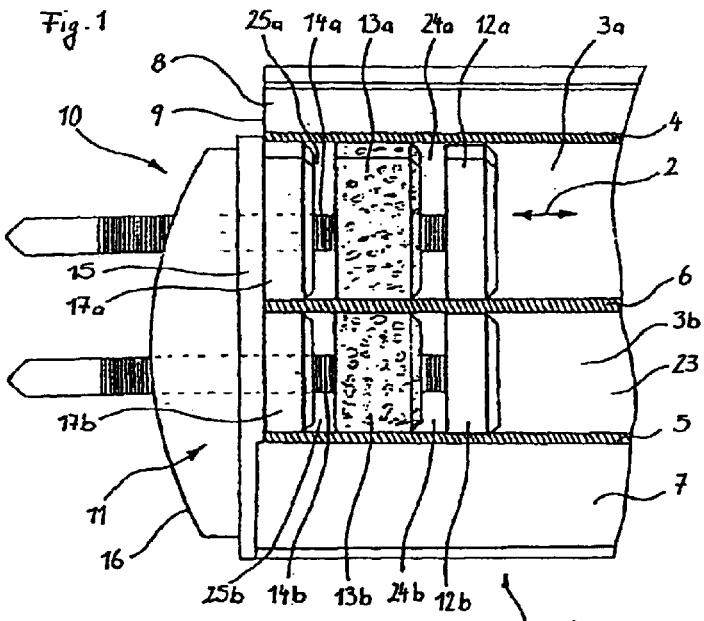
FIG. 1 shows a top view of a closure of a roller shutter profile represented in sections.

DETAILED DESCRIPTION OF PREFERRED EXAMPLE EMBODIMENTS AND OF THE BEST MODE OF THE INVENTION

A roller shutter profile 1 which is shown in FIGS. 1 to 4 in sections in a longitudinal sectional view consists of a thermoplastic material (e.g. PVC) and is produced by way of extrusion. The roller shutter profile 1 comprises two hollow chambers 3*a* and 3*b* which extend in its longitudinal direction 2 and are delimited by two longitudinal walls 4 and 5 as well as a separating wall 6 extending between the hollow chambers 3*a* and 3*b*. Adjacent to the longitudinal wall 5 there is a further chamber 7 which is open on its longitudinal side and in which engages a bridge-like hook strip 8 of an adjacent roller shutter profile, thus producing a flexible connection between two or a plurality of roller shutters 1. A roller shutter armor is formed in this way from a plurality of extruded profile elements which extend parallel with respect to each other, e.g. for a swimming pool cover which can be wound up or off.

From a face side 9 of the roller shutter profile 1, the same is sealed off in a water-proof manner by means of a closure 10. The closure 10 consists of a cap 11, two piston plates 12*a* and 12*b*, two sealing bodies 13*a* and 13*b* as well as two connecting elements 14*a* and 14*b*. Cap 11 comprises a plate 15, a rounded sliding strip 16 which projects therefrom in a rectangular manner as well as two stopper sections 17*a* and 17*b* which are adjusted to the cross section of the hollow chambers 3*a* and 3*b* like the piston plates 12*a* and 12*b* and the sealing bodies 13*a* and 13*b*. The stopper sections 17*a* and 17*b* penetrate with their entire length into the hollow chambers 3*a* and 3*b*, whereas the plate 15 rests on the face sides of the roller shutter profile 1.

The connecting elements 14*a* and 14*b* are integrally connected with the respective piston plates 12*a* and 12*b* and consist of nylon. The upper side of the flexible rod-shaped connecting elements 14*a* and 14*b* is provided with barbs 18. The connecting elements 14*a* and 14*b* penetrate the sealing bodies 13*a* and 13*b* in breakthroughs (not shown) which with respect to their cross section are adjusted to the cross section of the connecting elements 14*a* and 14*b*. Similarly, said connecting elements 14*a* and 14*b* also penetrate the cap 11 in the region of the stopper sections 17*a* and 17*b* as well as the plate 15 in adjusted breakthroughs 19*a* and 19*b* (cf. FIG. 3). Detent pawls 20*a* and 20*b* are provided within the plate 15 on the upper side of the breakthroughs 19*a* and 19*b*, which detent pawls cooperate with the barbs 18 of the connecting elements 14*a* and 14*b* and prevent a movement of the same in the direction of arrow 21.

The sealing bodies 13*a* and 13*b* consist of a rubber-elastic plastic material of a low hardness. The material is UV-resistant and can resist temperatures of up to at least 100° C. because due to insolation on the upper and lower walls 22 and 23 of the roller shutter profile far from inconsiderable temperatures can occur in the region of the closure 10. Suitable materials are silicone elastomers, fluorine elastomers, fluorosilicone elastomers or blending elastomers from the unvulcanized rubbers of the aforementioned elastomers or polyurethanes.

Figure 2:
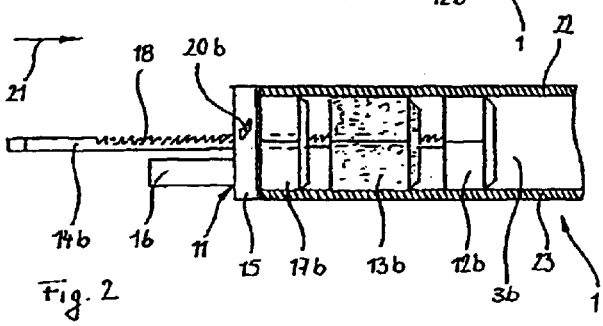
FIG. 2 shows a side view of the closure according to FIG. 1.
Figure 4:
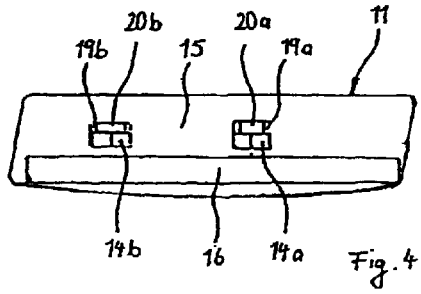
FIG. 4 shows a front side of the closure according to FIG. 1.

FIGS. 1 and 2 show the closure 10 in its mounting state. The cross section of the sealing bodies 13*a* and 13*b* which are free from the external forces is adjusted to the hollow chambers 3*a* and 3*b*, so that the pre-mounted closure 10 can be introduced with all its parts (as shown in FIGS. 1 and 2) from the face-side end of the roller shutter profile 1. The transfer of the closure 10 or the sealing body 13*a* and 13*b* to the sealing state (not shown in the drawing) is performed in a simple manner, such that the connecting elements 14*a* and 14*b* are pulled out of the hollow chambers 3*a* and 3*b* against the direction of the arrow 21, with the cap 11 being held in its contact position on the face side 9 of the roller shutter profile 1. By pulling out the connecting elements 14*a* and 14*b*, the piston plates 12*a* and 12*b* are pushed against the sealing bodies 13*a* and 13*b* and these two components then jointly against the stopper sections 17*a* and 17*b* of cap 11. Once the tensile force on the connecting elements 14*a* and 14*b* is further increased after reducing the intermediate spaces 24*a* and 24*b* and 25*a* and 25*b* to zero, there will be an elastic deformation of the same or, depending on the chosen material of the sealing bodies 13*a* and 13*b*, even a plastic deformation of the same. As a result of the pressure exerted in the longitudinal direction 2 of the hollow chambers 3*a* and 3*b*, the sealing bodies 13*a* and 13*b* will extend in the direction perpendicular thereto, so that as a result of the increase in the cross section of the sealing bodies 13*a* and 13*b* there will be a circumferentially tight contact of the same on the longitudinal walls 4 and 5, the separating wall 6 as well as the upper and lower wall 22 and 23 of the roller shutter profile 1. As a result of the compressive strain on the sealing bodies 13*a* and 13*b* produced by the tensile stress in the connecting elements 14*a* and 14*b*, there will also be a circumferentially tight contact of the mutually facing plane face sides of the contact surfaces of the piston plates 12*a* and 12*b* and the sealing bodies 13*a* and 13*b* as well as the latter and the stopper sections 17*a* and 17*b* of the cap 11. It is prevented in this way that liquid can reach along the connecting elements 14*a* and 14*b* through the breakthroughs 19*a* and 19*b* into the stopper sections 17*a* and 17*b* and through the breakthroughs into the sealing bodies 13*a* and 13*b* into the interior of the hollow chambers 3*a* and 3*b*.

Figure 3:
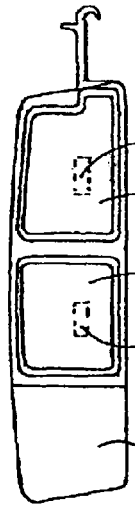
FIG. 3 shows a rear view of the closure according to FIG. 1.

As shown in FIG. 3, the cross-sectional shape of the chambers 3*a* and 3*b*, and thus also of the stopper sections 17*a* and 17*b*, the sealing bodies 13*a* and 13*b*, and the piston plates 12*a* and 12*b*, can be a polygon having plural straight sides or edges. For example, the chamber 3*b* has a four-sided rectangular shape, while the chamber 3*a* has a six-sided complex polygon shape.

Figure 5:
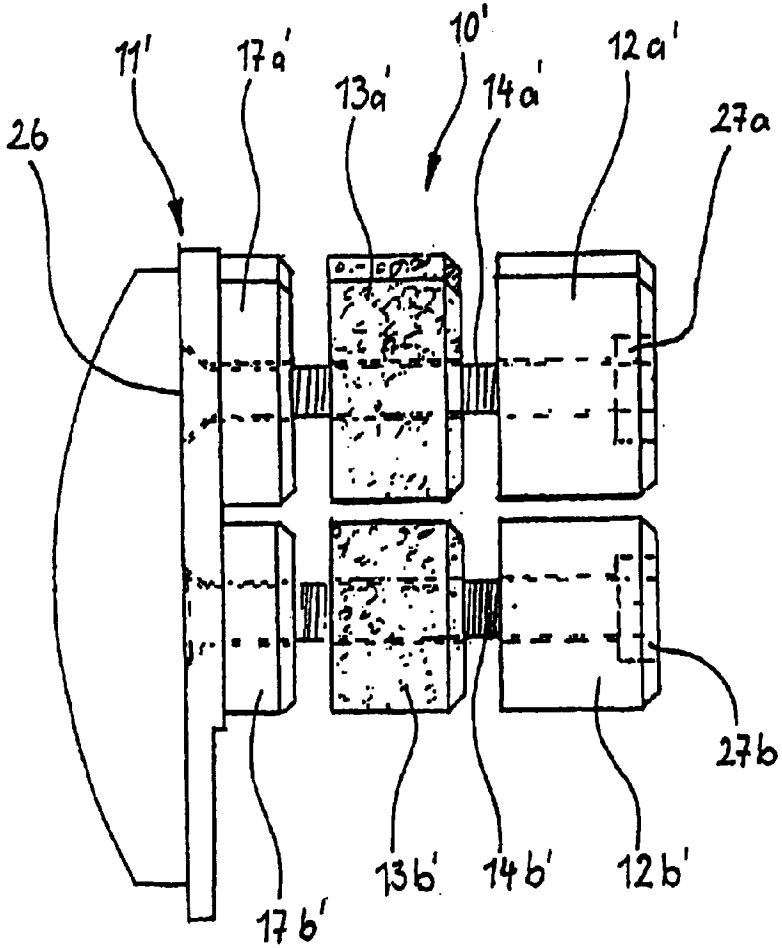
FIG. 5 shows an alternative closure with connecting elements in the form of machine screws.

The closure 10' as shown in FIG. 5 differs from that shown in FIGS. 1 to 4 merely in the respect that the connecting elements 14*a*' and 14*b*' are configured as machine screws made of stainless special steel with a recessed countersunk head screw 26. The ends of the connecting elements 14*a*' and 14*b*' which are averted from the cap 11' cooperate with nuts 27*a* and 27*b* which are also made of stainless special steel. Said nuts 27*a* and 27*b* are simultaneously injected over when the piston plates 12*a*' and 12*b*' are produced by means of injection molding. The reduction in the distance between the piston plates 12*a*' and 12*b*', the sealing bodies 13*a*' and 13*b*' and the stopper sections 17*a*' and 17*b*' of the cap 11' occurs by turning the screws. The radial expansion which occurs by pressing the sealing bodies 13*a*' and 13*b*' and the thus achieved sealing can be removed again by a respective reverse turning of the screws. Consequently, the hollow chambers of the profiles which are closed off with such closures 10' can be accessed again at any time without destroying the sealing and having to produce the same with spare parts again.

Figure 6:
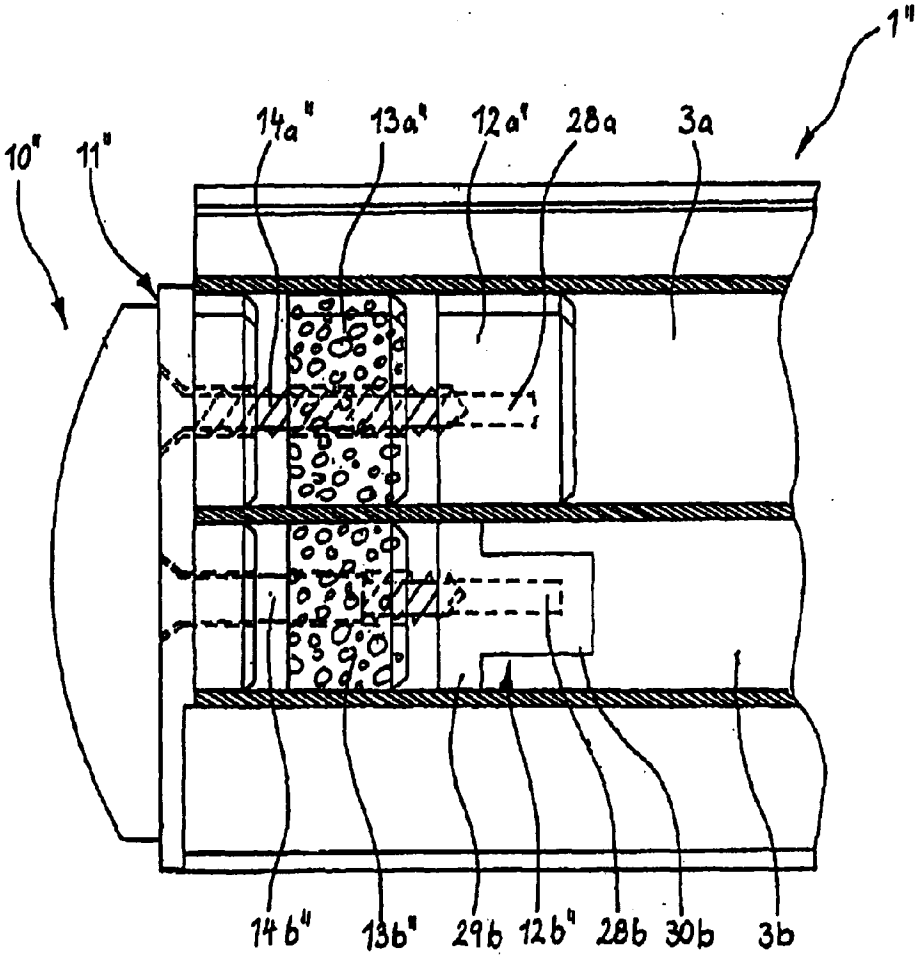
FIG. 6 shows a further alternative closure with connecting elements in the form of screws with self-cutting threads.

FIG. 6 shows a further alternative closure 10" in which the connecting elements 14*a*" and 14*b*" are configured as screws with a self-cutting thread. The ends the connecting elements 14*a*" and 14*b*" which are averted from the cap 11" engage in pocket bores 28*a* and 28*b* in the piston plates 12*a*" and 12*b*". The diameters of the pocket bores 28*a* and 28*b* which are shaped by means of injection-molding are smaller than the diameters of the screws. Whereas the thread extends over the entire shaft length of the screw in the connecting element 14*a*", the shaft of the connecting element 14*b*" is subdivided into a front part with a thread and a rear part without such a thread. The piston plate 12*b*" comprises a contact part 29*b* which faces the sealing body 13*b*" and whose cross section is adjusted to the cross section of the hollow chamber 3*b*, and comprises rear pin part 30*b* whose cross section is reduced with respect to the same.

The mounting of the connecting elements 14*a*' and 14*b*', 14*a*" and 14*b*" which are arranged as screws preferably occurs by means of torque-controlled tightening tools in order to produce a defined axial pre-tensioning on the sealing bodies 13*a*' and 13*b*', 13*a*" and 13*b*". The mounting of the closure 10 according to FIGS. 1 to 4 occurs preferably by means of a tool in the manner of tongs which produces at first a pretension on the rod-shaped connecting elements 14*a* and 14*b* and, when reaching a certain tensile force in analogy to the function of blind riveting tongs, causes a cut-off or notching and detachment of the projecting end of the connecting elements 14*a* and 14*b*. They can also be provided at the respective position with a defined break-off point which responds when a certain tensile stress is reached.

Figure 7:
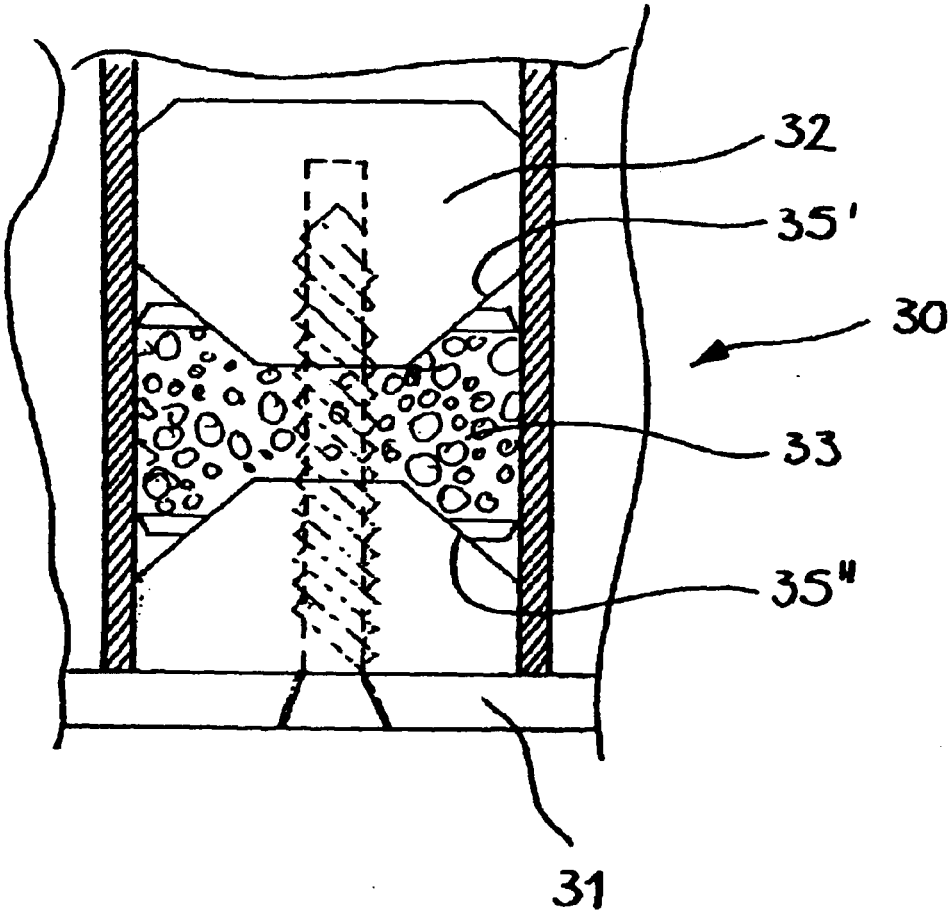
FIG. 7 shows a further alternative closure with cone-shaped/conical contact surfaces between sealing body and piston plate as well as sealing body and cap.

FIG. 7 shows a closure 30 in which the sealing body 33 which is penetrated by a screw has a shape which is provided at the two mutually opposite face-side contact surfaces 35' and 35" with a conical hollow. Both the piston plate 32 and the cap 31 have conical elevations in the region of the contact surfaces 35' and 35", which elevations are complementary to the hollows in the sealing body 33. The inclined surfaces which slide on each other during the axial pressing produce an especially favorable translation of the axial pre-tensioning into a radial expansion of the sealing body 33.

Figure 8:
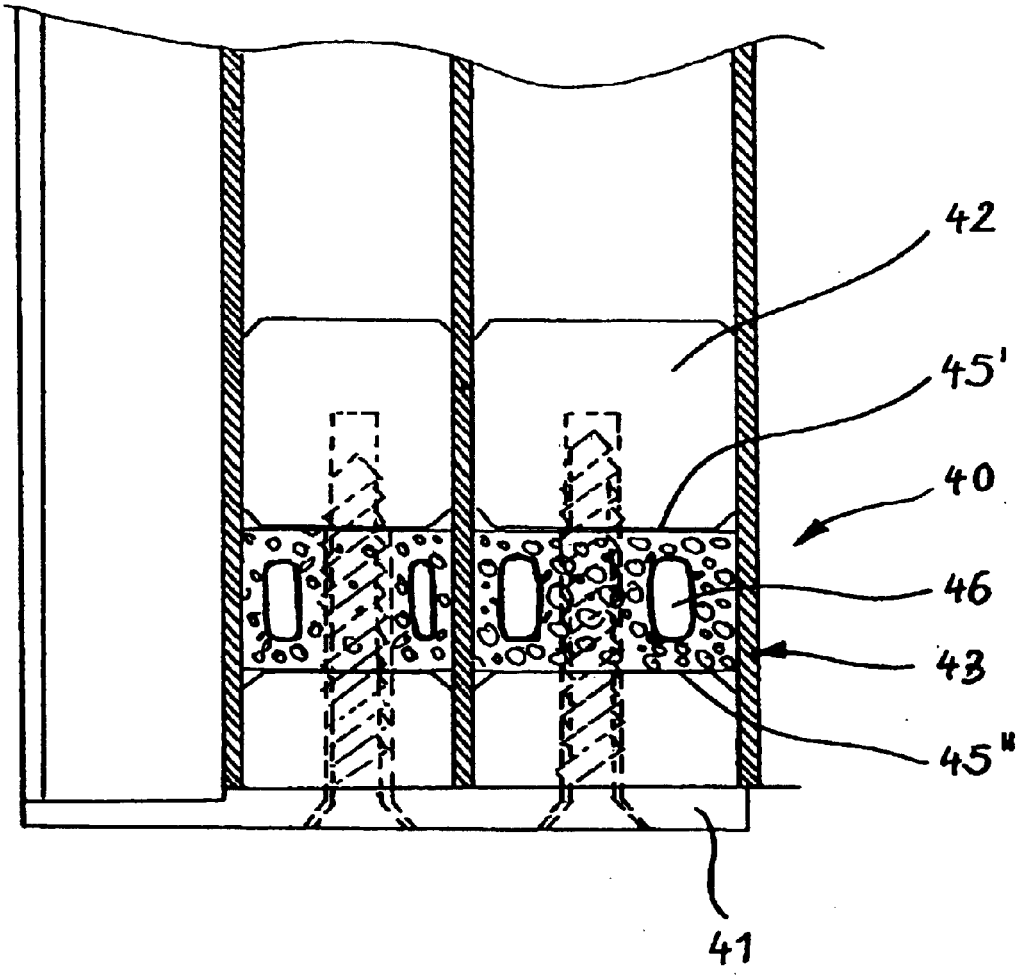
FIG. 8 shows a further alternative closure with a sealing body with an annular hollow chamber.

FIG. 8 finally shows a further embodiment of a closure 40 in which the piston plate 42 and the cap 41 and the substantially cylindrical sealing body 43 which is provided with a central pass-through bore for the screw are each provided with plane face-side contact surfaces 45' and 45". Differing from the sealing bodies as explained above, the sealing body 43 according to FIG. 8 comprises an annular, inherently closed and outwardly sealed hollow chamber 46. It has the shape of a torus with an oval cross section. The wall thickness of the sealing body 43 in the region between the hollow body 46 and the wall of the roller shutter profile is smaller than the wall between the hollow chamber 46 and the pass-through bore for the screw. The comparatively thin outside wall produces a high amount of flexibility in the sealing area, so that a reliable contact and thus sealing can be achieved. The hollow chamber 46 which is under axial pressure acts like a pneumatic spring which guarantees permanently maintaining the sealing effect.

What is claimed is:

1. An arrangement for a roller shutter cover for a swimming pool, comprising:

at least one elongated roller shutter profile that is made of a plastic or a metal, and that has at least one hollow chamber extending longitudinally in a longitudinal direction therealong, wherein said hollow chamber is bounded by profile walls of said roller shutter profile extending in said longitudinal direction and has an open end at an end of said roller shutter profile; and a water-tight closure that is adapted to close and water-tightly seal said open end of said hollow chamber, and that comprises a cap at least partly inserted into said open end, at least one pressure plate spaced apart from said cap within said hollow chamber adjacent to said open end, and at least one sealing body received between said cap and said pressure plate within said hollow chamber;

wherein:

said sealing body consists of a solid material that is deformable in at least one of an elastic manner and a plastic manner;

said sealing body is in a deformed state in which said sealing body is compressed in said longitudinal direction between said cap and said pressure plate and thereby expanded in a transverse direction perpendicular to said longitudinal direction so that an outer perimeter of said sealing body is pressed tightly against, and forms a continuous perimeter seal along, inner surfaces of said profile walls;

said cap and said pressure plate respectively have first and second flat planar surfaces extending parallel to each other in said transverse direction; and said sealing body has third and fourth flat planar surfaces extending parallel to each other in said transverse direction respectively along said first and second flat planar surfaces so that said sealing body in said deformed state is compressed in said longitudinal direction between said first and second flat planar surfaces of said cap and said pressure plate.

2. The arrangement according to claim 1, wherein said hollow chamber, at least a part of said cap inserted in said hollow chamber, said sealing body, and said pressure plate each respectively have a corresponding polygonal cross-sectional shape.

3. The arrangement according to claim 1, wherein said solid material of said sealing body is deformable in a plastic manner, and said deformed state of said sealing body is a permanent irreversible plastically deformed state.

4. The arrangement according to claim 1, wherein said solid material of said sealing body is deformable in an elastic manner, and said deformed state of said sealing body is a reversible elastically deformed state maintained by said cap and said pressure plate clamping said sealing body therebetween.

5. The arrangement according to claim 1, wherein said closure further comprises a tensile connecting element that extends in said longitudinal direction, connects said pressure plate to said cap, and selectively exerts a tensile force in said longitudinal direction between said pressure plate and said cap to establish said deformed state of said sealing body.

6. The arrangement according to claim 5, wherein said connecting element extends and penetrates entirely through a maximum longitudinal extent of said cap and said sealing body in said longitudinal direction.

7. The arrangement according to claim 5, wherein said pressure plate has an internal threading therein, and said connecting element comprises a screw with an external threading that cooperates with said internal threading.

8. The arrangement according to claim 5, wherein said cap has an opening therein with a one-way detent pawl, said connecting element is a barbed rod element having discrete individual barbs on a surface thereof, said barbed rod extends through said opening with a selected one of said barbs engaged with said pawl, and a cooperation of said pawl with said barbs allows said barbed rod element to slide in said longitudinal direction through said opening out of said hollow chamber but not oppositely into said hollow chamber.

9. The arrangement according to claim 1, wherein said at least one hollow chamber of said roller shutter profile includes plural hollow chambers, said cap integrally includes plural cap parts that respectively individually are inserted into said hollow chambers, said at leant one pressure plate includes plural pressure plates respectively individually arranged in said plural hollow chambers, and said at least one sealing body includes plural sealing bodies respectively individually arranged in said plural hollow chambers.

10. The arrangement according to claim 1, wherein said cap includes a tapering portion that becomes narrower as said tapering portion extends into said hollow chamber and that is truncated at said first planar surface, and said sealing body has a tapering concavity that has a floor bounded by said third flat planar surface and that mates with said tapering portion.

11. The arrangement according to claim 1, wherein said sealing body encloses a sealed gas-filled annular-shaped void therein.

12. An arrangement for a roller shutter cover for a swimming pool, comprising:

at least one elongated roller shutter profile that is made of a plastic or a metal, and that has at least one hollow chamber extending longitudinally in a longitudinal direction therealong, wherein said hollow chamber is bounded by profile walls of said roller shutter profile extending in said longitudinal direction and has an open end at an end of said roller shutter profile; and a water-tight closure that is adapted to close and water-tightly seal said open end of said hollow chamber, and that comprises a cap at least partly inserted into said open end, at least one pressure plate spaced apart from said cap within said hollow chamber adjacent to said open end, and at least one sealing body received between said cap and said pressure plate within said hollow chamber;

wherein:

said sealing body consists of a solid material that is deformable in at least one of an elastic manner and a plastic manner;

said sealing body is in a deformed state in which said sealing body is compressed in said longitudinal direction between said cap and said pressure plate and thereby expanded in a transverse direction perpendicular to said longitudinal direction so that an outer perimeter of said sealing body is pressed tightly against, and forms a continuous perimeter seal along, inner surfaces of said profile walls; and said hollow chamber, at least a part of said cap inserted in said hollow chamber, said sealing body, and said pressure plate each respectively have a corresponding polygonal cross-sectional shape.

13. The arrangement according to claim 12, wherein said polygonal cross-sectional shape is a rectangular polygonal shape.

14. The arrangement according to claim 12, wherein said polygonal cross-sectional shape is a complex irregular polygonal shape.

15. An arrangement for a roller shutter cover for a swimming pool, comprising:

at least one elongated roller shutter profile that is made of a plastic or a metal, and that has at least one hollow chamber extending longitudinally in a longitudinal direction therealong, wherein said hollow chamber is bounded by profile walls of said roller shutter profile extending in said longitudinal direction and has an open end at an end of said roller shutter profile; and a water-tight closure that is adapted to close and water-tightly seal said open end of said hollow chamber, and that comprises a cap at least partly inserted into said open end, at least one pressure plate spaced apart from said cap within said hollow chamber adjacent to said open end, and at least one sealing body received between said cap and said pressure plate within said hollow chamber;

wherein:

said sealing body consists of a solid material that is deformable in at least one of an elastic manner and a plastic manner;

said sealing body is in a deformed state in which said sealing body is compressed in said longitudinal direction between said cap and said pressure plate and thereby expanded in a transverse direction perpendicular to said longitudinal direction so that an outer perimeter of said sealing body is pressed tightly against, and forms a continuous perimeter seal along, inner surfaces of said profile walls; and said solid material of said sealing body is deformable in a plastic manner, and said deformed state of said sealing body is a permanent irreversible plastically deformed state.

16. The arrangement according to claim 15, wherein said outer perimeter of said sealing body in said deformed state is adhered onto said inner surfaces of said profile walls.

* * * * *

UNITED STATES PATENT AND TRADEMARK OFFICE

CERTIFICATE OF CORRECTION

PATENT NO. : 6,910,233 B2
DATED : June 28, 2005
INVENTOR(S) : Helge

It is certified that error appears in the above-identified patent and that said Letters Patent is hereby corrected as shown below:

Title page,
Item [74], *Attorney, Agent, or Firm*, replace “W. F. Fasse; W. F. Fasse” with
-- W. F. Fasse; W. G. Fasse --;
Item [57], ABSTRACT,
Line 3, after “an end of at”, replace “learnt” with -- least --;

Column 9,
Line 17, after “said at”, replace "leant" with -- least --.

Signed and Sealed this

Twentieth Day of December, 2005

JON W. DUDAS
*Director of the United States Patent and Trademark Office*